US007017606B1

(12) United States Patent
Sanders

(10) Patent No.: US 7,017,606 B1
(45) Date of Patent: Mar. 28, 2006

(54) PRIMARY-SECONDARY PUMPING SYSTEM

(76) Inventor: Gordon Sanders, 7103 Aberdeen, Lubbock, TX (US) 79424

( * ) Notice: Subject to any disclaimer, the term of this patent is extended or adjusted under 35 U.S.C. 154(b) by 411 days.

(21) Appl. No.: 10/431,041

(22) Filed: May 8, 2003

(51) Int. Cl.
*F25D 17/02* (2006.01)

(52) U.S. Cl. ..... 137/563; 137/565.3; 137/565.33

(58) Field of Classification Search ..... 62/185, 62/435; 137/563, 565.29, 565.3; 417/244, 417/250, 251
See application file for complete search history.

(56) References Cited

U.S. PATENT DOCUMENTS 3,825,084 A * 7/1974 Fruth et al. ..... 137/563
4,495,777 A * 1/1985 Babington ..... 62/185

* cited by examiner

*Primary Examiner*—Michael Koczo, Jr.
(74) *Attorney, Agent, or Firm*—Peter Loffler

(57) ABSTRACT

A primary-secondary pumping system for HVAC systems wherein the common pipe is configured so that there is at least a 4 ft pressure drop across the length of the common pipe and that all thermal plants see the same temperature of water entering the thermal plants and that return water sees the pressure drop of the common pipe before it sees the chilled (or heated) water leaving the thermal plant and the suction of the secondary pumps.

17 Claims, 1 Drawing Sheet

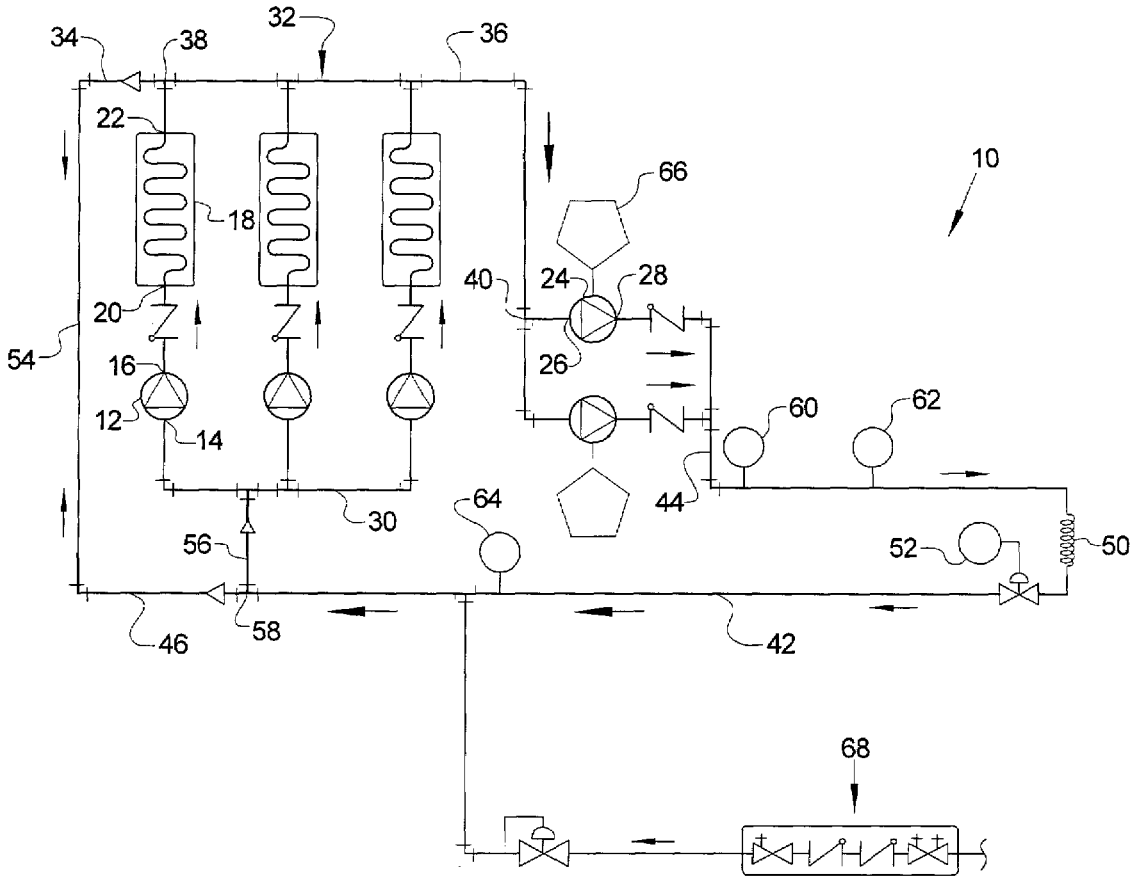
32
34
38
36
22
18
66
10
40
24
28
20
54
16
26
12
14
60
62
44
30
64
56
52
50
46
58
42
68

PRIMARY-SECONDARY PUMPING SYSTEM

BACKGROUND OF THE INVENTION

1. Field of the Invention

The present invention relates to a variable volume pumping HVAC system that uses a common pipe architecture to increase system efficiency and decrease initial system costs as well as decrease operating costs.

2. Background of the Prior Art

For over half a century, virtually all Heating, Ventilation, and Air Conditioning (HVAC) designs that have a large high Pressure drop distribution, such as systems that service a campus or an airport, have used systems which rely on primary-secondary pumping. The primary pumping within the primary or production system, provides constant volume pumping of the relatively low horsepower primary pumps through the chillers, boilers or heat exchangers. The lower horsepower of the primary pumps relative to the secondary pumps is due to the fact that the primary pumps need only to overcome the frictional loss associated with the chillers, boilers, heat exchangers, pipes and valves found in the primary loop. The secondary pumps within the secondary or distribution system, require a much higher horsepower as these pumps must overcome the frictional loss within the secondary loop due to the distribution piping, the fittings, the valves, the coils, etc. Accordingly, these secondary pumps normally are not operating efficiently. To overcome this efficiency problem, several attempts have been made including having the distribution system operate at variable volumes and use either constant speed pumps that ride the pump curves or incorporate variable frequency drives.

In such variable volume pumping systems, three key areas are of critical concern to the system designer, the common or decouple pipe, the chiller, boiler, or heat exchanger sequencing, and the temperature and flow requirements at the point of use.

The common pipe hydraulically decouples the primary pumps from the secondary pumps while allowing thermal interaction. Current design criteria assumes that the largest flow in the primary loop is passing through the common pipe and the maximum pressure drop across the common pipe should not exceed 1.5 ft. The theory is higher friction loss in the common pipe tends to make the primary pumps and the secondary pumps act in series which results in an induced flow in the system. In order to eliminate mixing due to excessive return velocity in the secondary return piping, three pipe diameters of separation are maintained between the secondary supply tee and the secondary return tee. A longer length pipe may result in a pressure drop greater than 1.5 ft.

Proper chiller, boiler and heat exchanger sequencing is another critical aspect of the primary-secondary pumping system in order to maintain overall system efficiency while allowing for proper flows and temperatures at the point of use. The chillers operate in one of three different flow conditions. The first flow condition is where the flow of the secondary system equals the flow of the primary system. In such conditions, which rarely ever occur, the flow coming out of the secondary system is equal to the flow intake of the primary system which results in a thermal balance and no flow in the common pipe.

The second flow condition occurs when the flow coming out of the secondary system exceeds the flow intake of the primary system. In such a condition, the increased load placed on the system results in the secondary pumps requiring more flow than is being produced by the fixed flow of the balanced chillers. As a result the secondary pumps run out on their curves due to the reduction in pressure. The excess flow required by the secondary system must flow through the common pipe. As a result, the water running through the common pipe blends with the supply water leaving the primary pumps and results in a higher water temperature (in an air conditioning mode) than what the chiller produces, which can result in a loss of humidity control. In order to combat this, a another chiller can be brought online in order increase the flow out of the primary system in order to eliminate the blending of the return water with the supply water. Another option is to reset the temperature of the currently operating chiller temperatures to a lower temperature so that the supply water leaving the primary system is at a lower temperature in order to compensate for the blending with the higher temperature return water coming through the common pipe. Each of these options, while addressing the problem at hand, resulting in lower overall system efficiency and higher operating costs.

The third flow condition occurs when the flow from the production system exceeds the flow passing through the distribution system. As the secondary system is pumping at its desired load, the excess flow being produced by the primary system is feed back through the common pipe where it is mixed with the return water supply, resulting in a lowering of the return water supply temperature. While this is desired, improper mixing in the common pipe can lead to excessive unloading and short cycling of the chillers, boilers and heat exchangers, creating excessive starts and thereby shorten the life span of the equipment.

Therefore, it is incumbent on the designer of the primary-secondary pumping system to select chillers in appropriate sizes and to sequence their staging and destaging in order to as closely balance primary and secondary flow as possible. Although this will result in higher operating efficiency and point of use performance, it is not an easy task.

Another critical design feature of the primary-secondary pumping system are the coil selections and control valves and actuators whose functions are to vary the flow properly through the water coils under a variety of system load conditions. If an undersized valve is selected, insufficient flow capacity will be achieved while an oversized valve will produce poor system control.

In reality, many HVAC systems engineers oversize the boilers and chillers of the system as well as the associated pumps in order to be assured of a system that can handle system load requirements. Alternately, many engineers undersize equipment and try to operate at higher Delta Ts and sequence the systems to operate at less than peak performance in order to achieve acceptable system response. In either scenario, either the cost of the system is excessive, or the operating costs are excessive relative to system requirements.

Therefore, in any primary-secondary pumping systems, great care must be taken in the architecture of the thermal plants and to achieve appropriate sequencing of the plants based on design temperatures and flow requirements of the system. System criteria should include, energy efficiency of the system, flow control of the system, system costs and minimization of system component wear and tear. In most designs, tradeoffs are made between the competing system criteria. Even if the systems are designed and configured to existing accepted design criteria, they tend not to operate at peek efficiency due to inherent problems in the current state of the art systems.

Many efficiency problems associated with primary-secondary pumping systems can be traced back to the common or decouple pipe. Current common pipe designs require that the maximum pressure drop not exceed 1.5 ft, which pressure drop is established by assuming that the flow of the largest chiller pump is passing through the common pipe. The diameter of the common pipe being the same as the diameters of the supply line and the return line as well as the relatively short length of the common pipe help maintain this relatively low pressure. The problem occurs during low and medium flow conditions. The present criteria recommends the architecture of the common pipe, the first opening from the secondary loop, flow to the suction side of the secondary pump. In such conditions, water flows in both directions in the common pipe at the same time resulting in no thermal interaction within the common pipe. As the water traveling in the pipe travels in a swirl, and as water is traveling in both directions within the pipe, due to the relatively low pressure drop across the pipe and the relatively low flow, thermal interaction only occurs at the point where both spirals touch, which results in water in the primary loop returning to the equipment at near the same temperature as the leaving temperature. This artificially unloads the equipment and a higher than desired temperature feeding the secondary loop. This causes the control valves to open to try to increase flow to the coils, which starts a cycle of excess flow, which in turn overloads the equipment, and the cycle starts all over again.

Therefore, there exists a need in the art for a primary-secondary pumping HVAC system that addresses the above-stated needs in the art. Specifically, such a system must simplify the proper selection of the appropriate sized boilers and chillers as well as the primary and secondary system pumps without the need to oversize them or to operate them at less than peak operating conditions in order to help assure a proper load distribution from the system. Such a system must be easy to design and easy to sequence and operate while tracking proper system load distribution in all loading environments.

SUMMARY OF THE INVENTION

The primary-secondary pumping HVAC system of the present invention addresses the aforementioned needs in the art. Specifically, primary-secondary pumping HVAC system utilizes an architecture of the de-couple (common pipe), a sequence of controls, and a staging of the multitude of equipment that utilize the efficiency of modern chillers and boilers, while maximizing savings on other equipment of the system, while assuring the proper load distribution of the system. The primary-secondary pumping system is easy to design and easy to sequence and operate and allows proper system load distribution in all loading environments.

The primary-secondary pumping system of the present invention is comprised of at least one primary pump having a primary inlet and a primary outlet. At least one thermal plant is provided such that each thermal plant has a plant inlet that is fluid flow connected to a respective one primary inlet of the at least one primary pump and each thermal plant has a plant outlet. A secondary pump has a secondary inlet and a secondary outlet. A return manifold fluid flow connects to each of the primary inlets of the at least one primary pump. A primary collection pipe has a pipe inlet and a pipe outlet, the primary collection pipe fluid flow is connected to each of the plant outlets of the at least one thermal plant, the primary collection pipe outlet is also fluid flow connected to the secondary inlet of the secondary pump. A return pipe has a return inlet that is fluid flow connected to the secondary outlet and has a second return outlet. A common pipe is fluid flow connected between the return outlet and the manifold inlet. A connector is fluid flow connected between the return manifold and the return pipe. The diameter of the common pipe is less than the diameter of the return pipe and less than the diameter of the primary collection pipe. The pressure differential between the return pipe and the primary collection pipe across the common pipe is at least ½ of the pressure of the thermal plant. Each of the plant outlets is connected to the primary collection pipe by in appropriate fashion such as by way of a T-fitting. The connector is connected to the return manifold in appropriate fashion such as by a T-fitting while the connector is also connected to the return pipe in similar fashion. The connector is disposed between the return inlet and the return outlet.

BRIEF DESCRIPTION OF THE DRAWINGS

FIG. 1 is a schematic diagram of the primary-secondary pumping system of the present invention.

Similar reference numerals refer to similar parts throughout the several views of the drawings.

DESCRIPTION OF THE PREFERRED EMBODIMENT

Referring now to the drawings, it is seen that the primary-secondary pumping system of the present invention, generally denoted by reference numeral 10, is comprised of at least one primary pump 12 having a primary inlet 14 and a primary outlet 16. At least one thermal plant 18 (such as a boiler, a chiller, or heat exchanger) is provided such that each thermal plant 18 has a plant inlet 20 that is fluid flow connected to a respective one primary outlet 16 of the at least one primary pump 12 and each thermal plant 18 has a plant outlet 22. At least one secondary pump 24 has a secondary inlet 26 and a secondary outlet 28. The secondary pump 24 may be of a variable frequency drive configuration.

A return manifold 30 fluid flow connects to each of the primary inlets 14 of the at least one primary pump 12. A primary collection pipe 32 has a pipe inlet 34 and a pipe outlet 36, the primary collection pipe 32 is fluid flow connected to each of the plant outlets 22 of the at least one thermal plant 18, with each of the plant outlets 22 connected to the primary collection pipe 32 in any appropriate fashion such as the illustrated T-fitting 38. The primary collection pipe outlet 36 is also fluid flow connected to the secondary inlet 26 of the secondary pump 24 (if more than one secondary pump 24 is present, appropriate fittings 40 are provided to sequence flow from the primary collection pipe 32 to each of the secondary pumps 24). A return pipe 42 has a return inlet 44 that is fluid flow connected to the secondary outlet 28 of the secondary pump 24 and the return pipe 42 has a return outlet 46. Appropriate fittings can be used to connect the outlets 28 of each secondary pump 24 to the return pipe if more than one secondary pump 24 is used. A load 50 is disposed along the length of the return pipe 42. An appropriate thermostat 52 controls operation of the load 50.

A common pipe 54 is fluid flow connected between the return outlet 46 of the return pipe 42 and the manifold inlet 30. The diameter of the common pipe 54 is less than the diameter of the return pipe 42 and less than the diameter of the primary collection pipe 32. The pressure differential between the return pipe 42 and the primary collection pipe 32 across the common pipe 54 is at least ½ of the pressure of the thermal plant 18. The smaller diameter of the common pipe 54 relative to the diameter of the return pipe 42 and the diameter of the primary collection pipe 32 help achieve this pressure differential irrespective of the length of the common pipe 54. This pressure differential helps stabilize the net positive suction on the primary pumps 12.

A connector 56 is fluid flow connected between the return manifold 30 and the return pipe 42. The connector 56 is connected to the return manifold 30 in appropriate fashion such as by the illustrated T-fitting 58 while the connector 56 is also connected to the return manifold 30 in similar fashion. The return manifold 30 assures that all thermal plants 18 see the same temperature of water entering the thermal plants 18. Additionally, this configuration also assures that return water sees the pressure drop of the common pipe 54 before it sees the chilled water leaving the thermal plant 18 and the suction of the secondary pumps 24.

In this configuration, the primary pumps 12 pump water through the thermal plants 18 at a constant rate. The chilled water supply is collected by the primary collection pipe 32 and is pumped through the secondary pump 24 to the load 50 in order to undergo a thermal transfer at the point of use. The chilled water is now at a higher temperature (in an air conditioning system, in a heating mode, the reverse of the system is true), and flows through the return pipe 42 and into the return manifold 30 to begin its cycle again.

If the distribution flow is greater than the production flow then some of the water in the return pipe 42 flows into the common pipe 54 instead of going into the return manifold 30. This water that flows through the common pipe 54 enters the primary collection pipe 32 through its pipe inlet 34 and this water thermally interacts with the water entering the primary collection pipe 32 that is being pumped through the chillers (or boilers in a heating mode) by the primary pumps 12. The blended water is then sent to the secondary pump 24. If this blended water is above a certain threshold, for example 2 degrees above the desired temperature set by the operators, with the sampling being taken at an appropriate point down stream of the secondary pump 24, for a certain amount of time set of the operator, for example 1 minute, then another thermal plant 18 is brought online.

If the production flow is greater than the distribution flow then some of the water in the primary collection pipe 32 flows into the common pipe 54 instead of going to the secondary pump 24. This water that flows through the common pipe 54 and enters the return pipe 42 through the return outlet 46 and this water thermally interacts with the water in the return pipe 42. The blended water is then sent to the primary pumps 12. If this blended water is below a certain threshold, for example 2 degrees below the desired temperature set by the operators, with the sampling again being taken at an appropriate point down stream of the secondary pump 24, for a certain amount of time set of the operator, for example 1 minute, then a thermal plant 18 is brought off-line.

The above examples were provided for an air conditioning mode, however, the system works similarly in a heating mode, with reversals in the appropriate terms in the above examples. Additionally, the terms "inlet" and "outlet" through this application are provided for convenience of reference and should in no way be understood to limit or other wise restrict their function to that of allowing inflow only or outflow only, respectively.

An example of the proper sequencing for the three thermal plant 18 configuration illustrated, in an air conditioning setting are as follows. The primary loop is set to operate at a lower temperature than the secondary loop, about 3–4 degrees Fahrenheit. The primary chilled water set point is 42 degrees Fahrenheit. In stage 1, the system is set on, either by scheduling or by operator command. One of the chillers (thermal plant 18) is set to lead, the second chiller is set to stage 2, and the third chiller is set to stage 3, the particular selection 10 being operator determined. Chiller 1 has its set point set to 42 degrees. The primary pump 12 for chiller 1 is interlocked to the on position. The secondary pump 24 is set to the on position, The condenser pump for chiller 1 is hardwire interlocked to the on position. The cooling tower for chiller 1 has a set point set to 70 degrees and is placed in the on position. Chiller 1 will run and maintain a 45 degree temperature at the temperature sampling point beyond the secondary pump 24 by an appropriate temperature sensor 60, after a time delay of about 15 minutes. If the temperature rises at least 2 degrees at the temperature sampling point above the set point, for 1 minute, the system will proceed to stage 2.

In stage 2, chiller 2 has a set point temperature of 42 degrees and is placed into the on position. The primary pump 12 for chiller 2 is interlocked to the on position. The condenser pump for chiller 2 is hardwire interlocked to the on position. The cooling tower for chiller 2 has a set point set to 70 degrees and is placed in the on position. Chiller 1 will run and maintain a 45 degree temperature at the temperature sampling point, after a time delay of about 15 minutes. Stage 2 will have a minimum run time, for example, of at least 30 minutes. If the temperature drops to about 43 degrees at the temperature sampling point, while in stage 2 and the minimum run time has been set, the system 10 returns to stage 1.

Stage 3 operates in the same manner as stage 2 and is brought online and off-line by the same criteria. If an alarm failure occurs in stage 1, the stage 2 (chiller 2, primary pump 12 for this chiller, etc.), becomes the lead stage and performs as if it were in stage 1 and stage 3 performs as if it were in stage 2.

The secondary pumps 24 are set up as lead lag. When the system 10 is on, the secondary pumps 24 are on. The set point of the pressure of the system 10 at a first pressure sampling point measured by a first pressure sensor 62 equals the design pressure drop across the cooling coil located farthest from the secondary pump 24 plus 5 PSI. The variable frequency drive 66 on the lead secondary pump 24 maintains the pressure set point at the first pressure sensor 62. An appropriate control program monitors the pressure set point at a second pressure sampling point measured by a second pressure sensor 64, which set point equals the standing pressure of the system 10. If the pressure at the second pressure sensor 64 drops 5 PSI below the set point, the variable frequency drive 66 will ramp up to maintain the pressure set point at the first pressure sensor 62 and an appropriate low water alarm is activated. If the pressure at the second pressure sensor 64 rises above its set point, the control program will maintain the pressure differential of the two set points and an appropriate high water alarm is activated.

The system has an appropriate make up subsystem 68.

While the invention has been particularly shown and described with reference to an embodiment thereof, it will be appreciated by those skilled in the art that various changes in form and detail may be made without departing from the spirit and scope of the invention.

I claim:

1. A primary-secondary pumping system comprising:

at least one primary pump having a primary inlet and a primary outlet;

at least one thermal plant, each having a plant outlet fluid flow connected to a respective one primary inlet of the at least one primary pump and each thermal plant having a plant inlet;

a secondary pump having a secondary inlet and a secondary outlet;

a return manifold fluid flow connected to each of the primary inlets of the at least one primary pump;

a primary collection pipe fluid flow connected to each of the plant outlets of the at least one thermal plant and fluid flow connected to the secondary, inlet of the secondary pump;

a return pipe fluid flow connected between the secondary outlet and the return manifold; and a common pipe fluid flow connected between the return pipe and the primary collection pipe, such that the common pipe has a first diameter, the return pipe has a second diameter, and the primary collection pipe has a third diameter and such that the first diameter is smaller than the second diameter or the third diameter.

2. The primary-secondary pumping system as in claim 1 wherein the pressure differential between the return pipe and the primary collection pipe across the common pipe is at least about ½ of the pressure of the thermal plant.

3. The primary-secondary pumping system as in claim 1 wherein each of the plant outlets is connected to the primary collection pipe by a T-fitting.

4. The primary secondary pumping system as in claim 1 wherein the secondary pump is controlled by a variable frequency drive.

5. A primary-secondary pumping system comprising:

at least one primary pump having a primary inlet and a primary outlet;

at least one thermal plant each having a plant outlet fluid flow connected to a respective one primary inlet of the at least one primary pump and each thermal plant having a plant inlet;

a secondary pump having a secondary inlet and a secondary outlet;

a return manifold fluid flow connected to each of the primary inlets of the at least one primary pump;

a primary collection pipe having a pipe inlet and a pipe outlet, the primary collection pipe fluid flow connected to each of the plant outlets of the at least one thermal plant, the primary collection pipe outlet fluid flow connected to the secondary inlet of the secondary pump;

a return pipe fluid flow, having a return inlet fluid flow connected to the secondary outlet and a return outlet;

a common pipe fluid flow connected between the return outlet and the pipe inlet; and a connector fluid flow connected between the return manifold and the return pipe wherein diameter of the common pipe is less than the diameter of the return pipe and less than the diameter of the primary collection pipe.

6. The primary-secondary pumping system as in claim 5 wherein the pressure differential between the return pipe and the primary collection pipe across the common pipe is at least about ½ of the pressure of the thermal plant.

7. The primary-secondary pumping system as in claim 5 wherein each of the plant outlets is connected to the primary collection pipe by a T-fitting.

8. The primary-secondary pumping system as in claim 5 wherein the connector is connected to the return manifold by a first T-fitting.

9. The primary-secondary pumping system as in claim 8 wherein the connector is connected to the return pipe by a second T-fitting.

10. The primary-secondary pumping system as in claim 5 wherein the connector is connected to the return manifold by a T-fitting.

11. The primary-secondary pumping system as in claim 5 wherein the connector is disposed between the return inlet and the return outlet.

12. The primary secondary pumping system as in claim 5 wherein the secondary pump is controlled by a variable frequency drive.

13. A primary-secondary pumping system comprising:

at least one primary pump having a primary inlet and a primary outlet;

at least one thermal plant, each having a plant outlet fluid flow connected to a respective one primary inlet of the at least one primary pump and each thermal plant having a plant inlet;

a secondary pump having a secondary inlet and a secondary outlet;

a return manifold fluid flow connected to each of the primary inlets of the at least one primary pump;

a primary collection pipe fluid flow connected to each of the plant outlets of the at least one thermal plant by a T-fitting and fluid flow connected to the secondary inlet of the secondary pump;

a return pipe fluid flow connected between the secondary outlet and the return manifold; and a common pipe fluid flow connected between the return pipe and the primary collection pipe.

14. The primary-secondary pumping system as in claim 13 wherein the pressure differential between the return pipe and the primary collection pipe across the common pipe is at least about ½ of the pressure of the thermal plant.

15. The primary secondary pumping system as in claim 13 wherein the secondary pump is controlled by a variable frequency drive.

16. A primary-secondary pumping system comprising:

at least one primary pump having a primary inlet and a primary outlet;

at least one thermal plant, each having a plant outlet fluid flow connected to a respective one primary inlet of the at least one primary pump and each thermal plant having a plant inlet;

a secondary pump having a secondary inlet and a secondary outlet, the secondary pump controlled by a variable frequency drive;

a return manifold fluid flow connected to each of the primary inlets of the at least one primary pump;

a primary collection pipe fluid flow connected to each of the plant outlets of the at least one thermal plant and fluid flow connected to the secondary inlet of the secondary pump;

a return pipe fluid flow connected between the secondary outlet and the return manifold; and a common pipe fluid flow connected between the return pipe and the primary collection pipe.

17. The primary-secondary pumping system as in claim 16 wherein the pressure differential between the return pipe and the primary collection pipe across the common pipe is at least about ½ of the pressure of the thermal plant.

* * * * *